United States Patent [19]

Cazaux et al.

[11] Patent Number: 4,480,678

[45] Date of Patent: Nov. 6, 1984

[54] APPARATUS FOR CONTROLLING AND GUIDING OSCILLATIONS OF A CONTINUOUS CASTING MOLD

[75] Inventors: Joel Cazaux, Chelles; Joseph Pietryka, Versailles, both of France

[73] Assignee: Fives-Cail Babcock, Paris, France

[21] Appl. No.: 405,388

[22] Filed: Aug. 5, 1982

[30] Foreign Application Priority Data

Aug. 10, 1981 [FR] France ..... 81 15430
Apr. 20, 1982 [FR] France ..... 82 06730

[51] Int. Cl.[3] ..... B22D 11/04; B22D 27/08
[52] U.S. Cl. ..... 164/416; 164/478
[58] Field of Search ..... 164/416, 478, 260, 261, 164/71.1

[56] References Cited

U.S. PATENT DOCUMENTS

| | | | |
|---|---|---|---|
| 3,343,592 | 9/1967 | Vogel | 164/416 |
| 3,523,571 | 8/1970 | Niskovskish et al. | 164/416 |
| 3,592,258 | 7/1971 | Simons | 164/416 |
| 3,822,738 | 7/1974 | Rotarides et al. | 164/416 |
| 3,886,995 | 6/1975 | Bollig et al. | 164/416 |
| 4,215,739 | 8/1980 | Borghorst | 164/416 |
| 4,263,960 | 4/1981 | Colombo | 164/416 |

FOREIGN PATENT DOCUMENTS

| | | | |
|---|---|---|---|
| 31133 | 7/1981 | European Pat. Off. | 164/416 |

*Primary Examiner*—Nicholas P. Godici
*Assistant Examiner*—J. Reed Batten, Jr.
*Attorney, Agent, or Firm*—Kurt Kelman

[57] ABSTRACT

An apparatus for controlling and guiding oscillations of a mold having an outlet for a continuous casting, comprises a fixed support, a first connecting rod pivotally connected to the mold at one end thereof, a first cam shaft carried by the fixed support, the first cam shaft having an axis extending perpendicularly to the axis of the continuous casting or to the direction of a tangent on the axis at a point adjacent the mold outlet and parallel to a vertical plane containing the axis, an end of the first connecting rod opposite to the one end being mounted on the first cam shaft, a second connecting rod pivotally connected to the mold at an end thereof, and a second cam shaft carried by the fixed support, the second cam shaft having a horizontal axis extending perpendicularly to the axis of the first cam shaft, an end of the second connecting rod opposite to the one end being mounted on the second cam shaft, the mounting of each connecting rod on a respective one of the cam shafts being arranged to prevent any movement of the connecting rod with respect to the fixed support and to the mold in a direction parallel to the axis of the respective cam shaft.

13 Claims, 8 Drawing Figures

APPARATUS FOR CONTROLLING AND GUIDING OSCILLATIONS OF A CONTINUOUS CASTING MOLD

The present invention relates to improvements in an apparatus for controlling and guiding oscillations of a mold having an outlet for a continuous casting, such as a steel slab, the mold having a straight or a curved molding passage for the continuous casting.

The control of the oscillations of a continuous casting mold is generally effected by a system of cam shafts operating connecting rods and levers linked to the mold or a support therefor. The guidance of the oscillatory mold aims at maintaining the axis of the molding cavity or passage coincidental with a theoretical curve which is called the axis of the continuous casting and is effected either by a set of control rods or levers, or by rollers or slides cooperating with guide surfaces on the mold support.

The present tendency is to increase the frequency of oscillations of continuous casting molds. However, known apparatus does not permit the mold to be operated at oscillation frequencies substantially above those heretofore used, which are of the order of about 100 to 150 oscillations per minute, because of their inertia and of inevitable tolerances which, at high oscillating frequencies, may cause damaging shocks tending to break the control elements.

It is the primary object of this invention to provide an apparatus for controlling and guiding oscillations of a continuous casting mold, which permits the mold to be oscillated at high frequencies up to about 400 oscillations per minute. This and other objects of the invention are attained by reducing the number of elements in the kinematic train between the control cam shafts and the mold to a minimum, and by utilizing the same elements for the control and guidance of the mold oscillations.

The above and other objects are accomplished according to the invention with an apparatus for controlling and guiding oscillations of a mold having an outlet for a continuous casting, which comprises a fixed support, a first connecting rod pivotally connected to the mold at one end thereof, a first cam shaft carried by the fixed support, the first cam shaft having an axis extending perpendicularly to the axis of the continuous casting or, if the molding passage for the continuous casting is curved, to the direction of a tangent on said axis at a point adjacent the mold outlet and parallel to a vertical plane containing said axis, an end of the first connecting rod opposite to the one end being mounted on the first cam shaft, a second connecting rod pivotally connected to the mold at an end thereof, and a second cam shaft carried by the fixed support, the second cam shaft having a horizontal axis extending perpendicularly to the axis of the first cam shaft, an end of the second connecting rod opposite to the one end being mounted on the second cam shaft, the mounting of each connecting rod on a respective one of the cam shafts being arranged to prevent any movement of the connecting rod with respect to the fixed support and to the mold in a direction parallel to the axis of the respective cam shaft. The two cam shafts are coupled together to be driven in synchronism.

The position of the pivot connection points of the connecting rods to the mold or its support and, consequently, the disposition of the cam shafts and the connecting rods is selected in relation to the shape and dimensions of the mold to reduce the mechanical stresses on the mold or the support thereof and/or to facilitate ready access to the mold. The connecting rods may be disposed at opposite sides of the mold or at the same side thereof.

In certain cases, it may be advantageous to provide a pair of one or both connecting rods to reduce the mechanical stresses on the mold or the support thereof, i.e. to provide two first and/or second connecting rods mounted on respective cam shafts which extend parallel to each other. If the two connecting rods are disposed at a small distance from each other, their cam shafts may be axially aligned. However, if the two connecting rods are disposed at a relatively large distance from each other, as may be the case in molds for producing steel slabs, which are of large dimensions, the axes of their cam shafts must be parallel and the connecting rods are arranged symmetrically with respect to a plane extending therebetween perpendicularly to the cam shaft axes. This disposition avoids subjecting the mold support and the mechanical oscillation control assembly to excessive stresses when the support expands.

In a continuous casting installation with a curved molding passage and guide rack, it is desirable to superimpose a pivoting movement about the axis of the pivot connecting the first connecting rod to the mold or the support thereof on the rectilinear movement imparted thereto by this cam shaft-driven connecting rod. These compound movements permit the mold to be displaced along a trajectory which, taking into account the small amplitude of the oscillations and the large radius of curvature, differs little from the theoretical curved trajectory or axis of the continuous casting. This is accomplished readily with first and second cam shafts having cams of different eccentricity, the cam closest to the center of curvature of the installation having a smaller eccentricity than that farther removed therefrom, and a universal joint pivotally connecting the first connecting rod to the mold or the support thereof. The universal joint may be a ball-and-socket joint, a difference between the actual and theoretical trajectories may cause the continuous casting to break whereby liquid metal may spill out of the resultant opening, if the center of the universal joint and the axis of the pivot connecting the second connecting rod to the mold define a plane extending perpendicularly to the axis of the continuous casting at a point where this axis intersects this plane. Preferably, this plane is situated near the lower face of the mold or extends therealong, and the axis of the first cam shaft is parallel to this plane when the mold is in its median position.

The above and other objects, advantages and features of the present invention will become more apparent from the following detailed description of certain now preferred embodiments thereof, taken in conjunction with the accompanying schematic drawing wherein FIG. 1 is a side elevational view of the upper part of a continuous casting machine with a mold having a curved molding passage and a curved guide rack, the machine incorporating an apparatus for controlling and guiding oscillations of the mold according to this invention;

Figure 1:
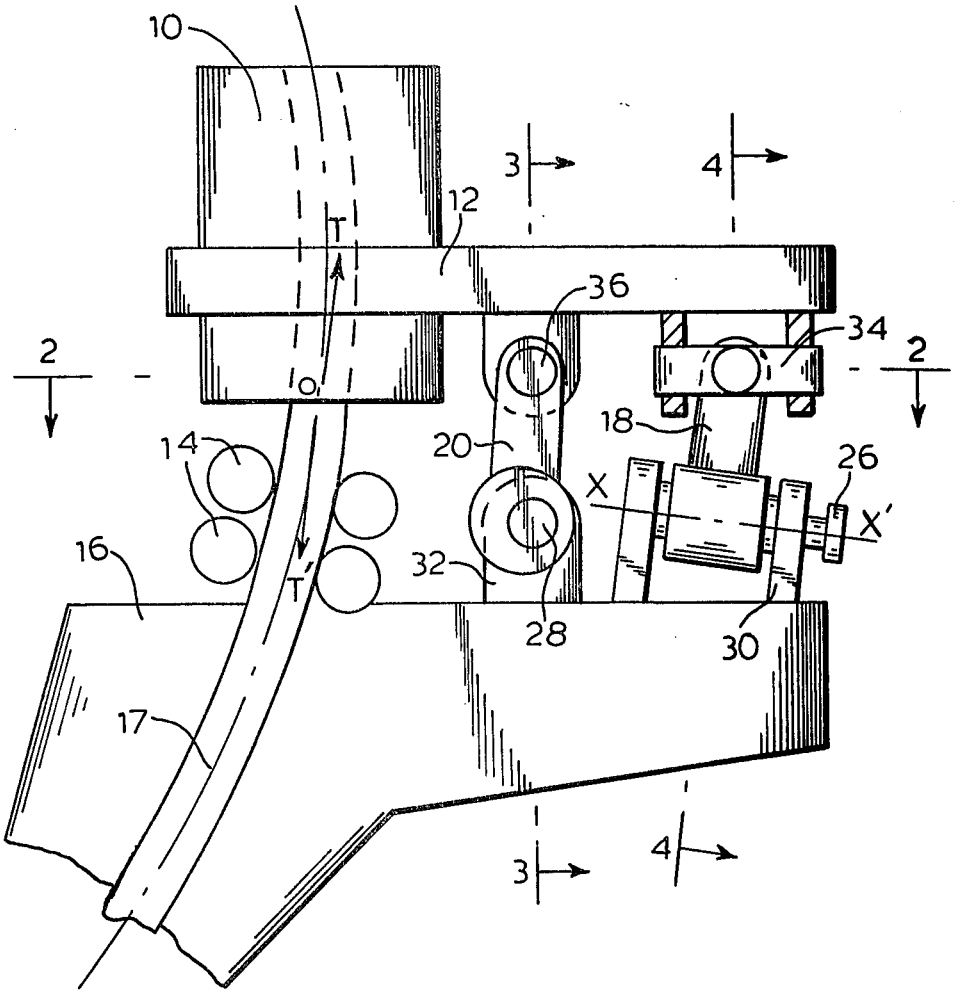

Referring now to the drawing, wherein like reference numerals designate like parts functioning in a like manner in all figures, FIGS. 1 to 4 show a continuous casting machine for producing billets or blooms. The illustrated machine comprises mold 10 affixed to support 12 constituted by an oscillating table. The mold has a curved molding passage and curved guide rack 14 for the continuous casting, the guide rack being mounted on support frame 16 and arranged in alignment with the molding passage for guiding the continuous casting from the discharge outlet of the mold during cooling of the casting. The guide rack, at least in the upper portion thereof, imparts to the continuous casting a curved trajectory extending along the arc of a circle. This trajectory is indicated by interrupted line 17 and is called the axis of the continuous casting throughout the specification and claims. This line represents, in fact, the trajectory of the center of any straight section of the casting.

Figure 3:
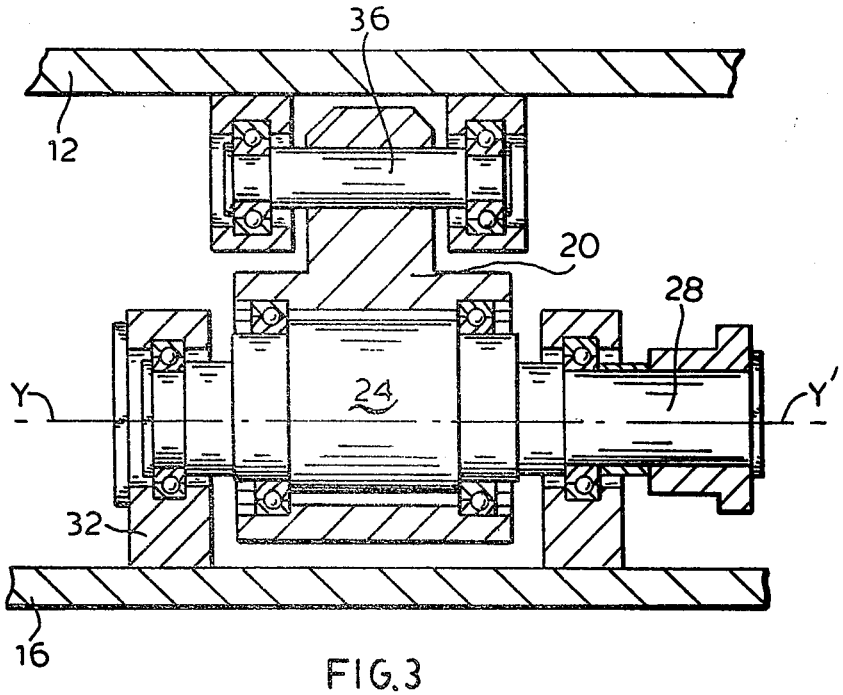
FIG. 3 is a vertical section along line 3—3 of FIG. 1.
Figure 4:
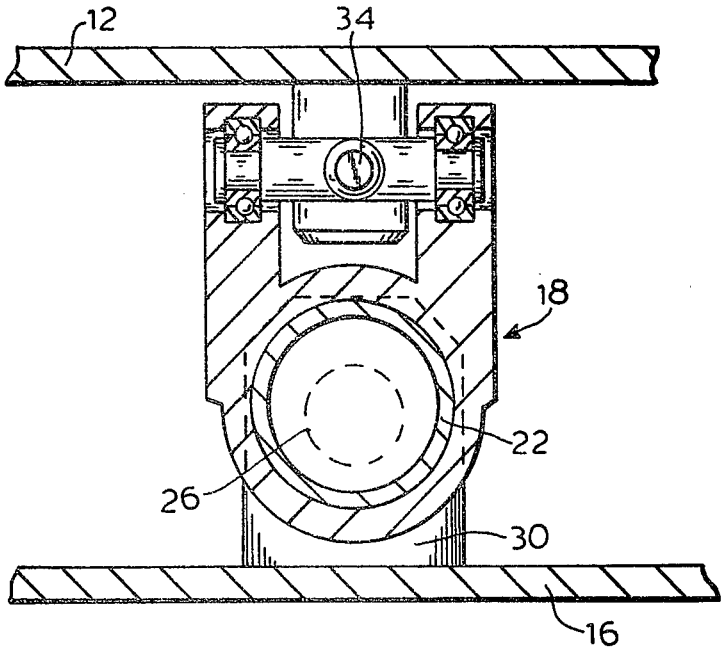
FIG. 4 is another vertical section along line 4—4 of FIG. 1.

The apparatus for controlling and guiding oscillations of mold 10 and its oscillating support table 12 comprises support frame 16 as fixed support, first or guiding connecting rod 18 pivotally connected to support 12 at one end thereof, first cam shaft 22, 26 carried by fixed support 16, an end of rod 18 opposite to the one end being mounted on cam shaft 22, 26, second or balancing connecting rod 20 pivotally connected to support 12 at one end thereof, second cam shaft 24, 28 carried by fixed support 16, and an end of rod 20 opposite to the one end being mounted on cam shaft 24, 28 (see particularly FIGS. 3 and 4). Shafts 26 and 28 of the first and second cam shafts are respectively journaled in bearings 30 and 32 affixed to fixed support 16, are respective cams 22 and 24 are integral with the shafts to form the first and second cam shafts. First cam shaft 22, 26 has axis X—X' extending perpendicularly to tangent TT' on axis 17 of the continuous casting at point 0 adjacent the mold outlet or in the plane of this discharge outlet and in a plane containing axis 17. An end of connecting rod 18 opposite to the one end is mounted on first cam shaft 22, 26. Second cam shaft 24, 28 has a horizontal axis extending perpendicularly to X—X' of the first cam shaft and an end of second connecting rod 20 opposite to the one end is mounted on the second cam shaft. The mounting of each connecting rod on a respective cam shaft is arranged to prevent any movement of the connecting rod with respect to fixed support 16 and to mold 10 in a direction parallel to the axis of the respective cam shaft. Connecting rod 18 imparts to mold 10 oscillations in a direction perpendicular to the axis of cam shaft 22, 26. Connecting rod 20 maintains oscillating support table 12 in a stable equilibrium to balance it while being oscillated.

In the illustrated embodiment, cardan joint 34 pivotally connects the one end of connecting rod 18 to oscillating mold support table 12 and shaft 36, whose axis is parallel to axis Y—Y' of shaft 28, pivotally connects the one end of connecting rod 20 to the oscillating mold support table.

Figure 2:
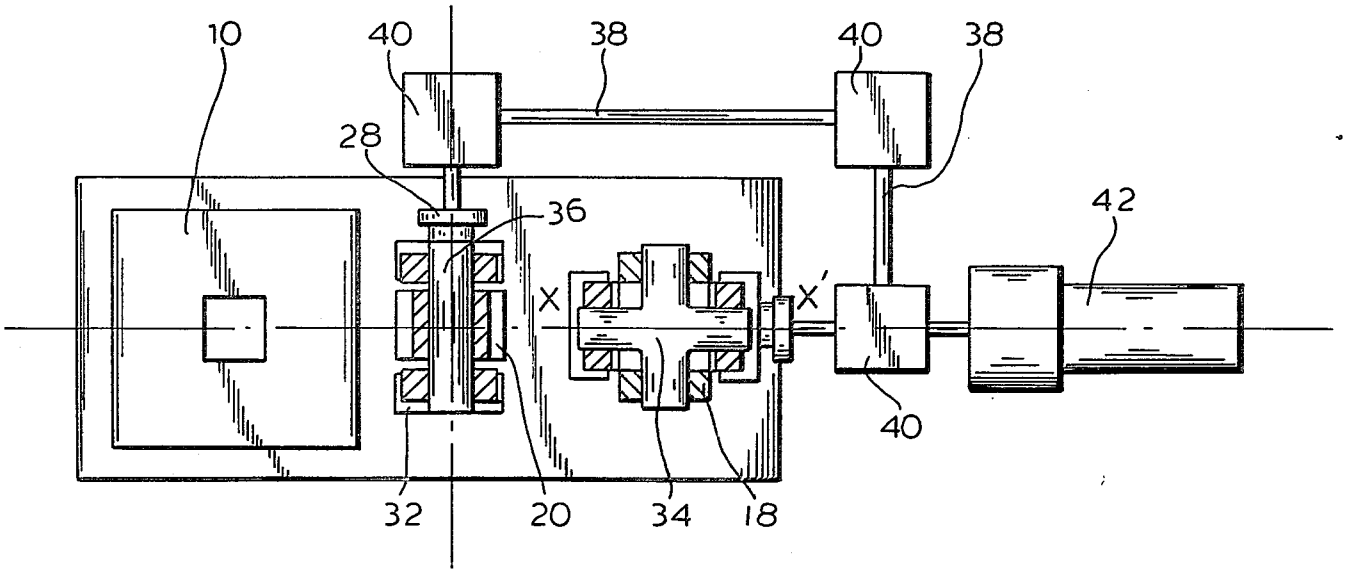
FIG. 2 is a horizontal section along line 2—2 of FIG. 1.

As shown in FIG. 2, the illustrated embodiment comprises means for synchronously driving the two cam shafts 22, 26 and 24, 28 at the same speed. This means includes coupling rods 38 and bevel gear arrangements 40 connected to drive motor 42.

The cam shafts have cams 22 and 24 of different eccentricity, the eccentricity of cam 24 being slightly less than that of cam 22 so that the rectilinear reciprocating movement in a direction parallel to tangent TT', which is imparted to connecting rod 18, is accompanied by a pivoting movement about shaft 36. These compound motions permit the mold to be displaced along a trajectory which differs little from the theoretical curved trajectory, at least at the discharge outlet of the mold where it is essential to keep the theoretical curvature.

Figure 5:
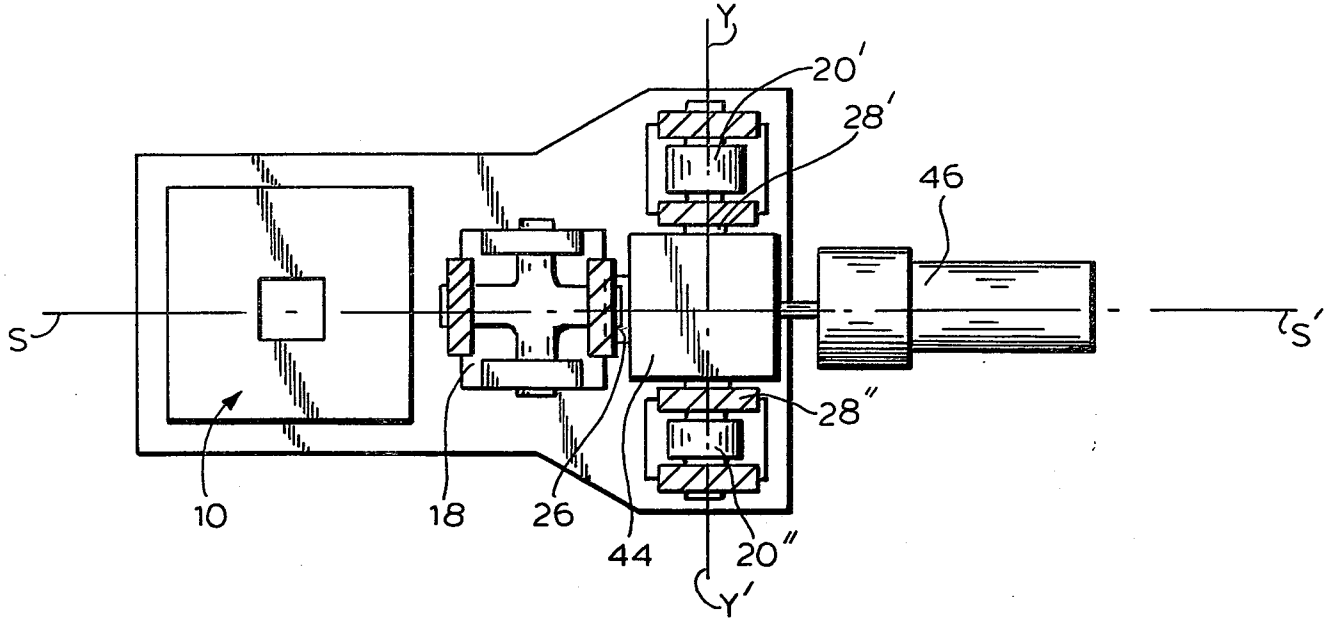
FIG. 5 is a sectional view analogous to that of FIG. 2 and illustrating another embodiment of the invention.

The embodiment of FIG. 5 provides a pair of second connecting rods 20' and 20'', the ends of the second connecting rods opposite to the one ends being mounted on a pair of second cam shafts 28' and 28''. The two second cam shafts are axially aligned and spaced from each other along axis Y—Y'. The positions of the first or guiding and second or balancing connecting rods are inversed with respect to mold 10 in this embodiment.

Rods 20', 20'' are symmetrically arranged with respect to plane of symmetry S—S' of the continuous casting machine. Shaft 26 of the first cam shaft and shafts 28' and 28'' of the pair of second cam shafts are coupled to three outputs of bevel gear box 44 affixed to the support frame of the machine between bearings for the cam shafts. The input of the bevel gear box is coupled to reduction motor 46.

In the embodiment of FIG. 5, the connecting rods are disposed, with respect to mold 10, opposite to the center of curvature of axis 17 of the continuous casting but first connecting rod 18 is closer to mold 10 than second connecting rods 20', 20'' and the eccentricity of cam 22 is less than that of the cams which operate rods 20' and 20''.

Figure 6:
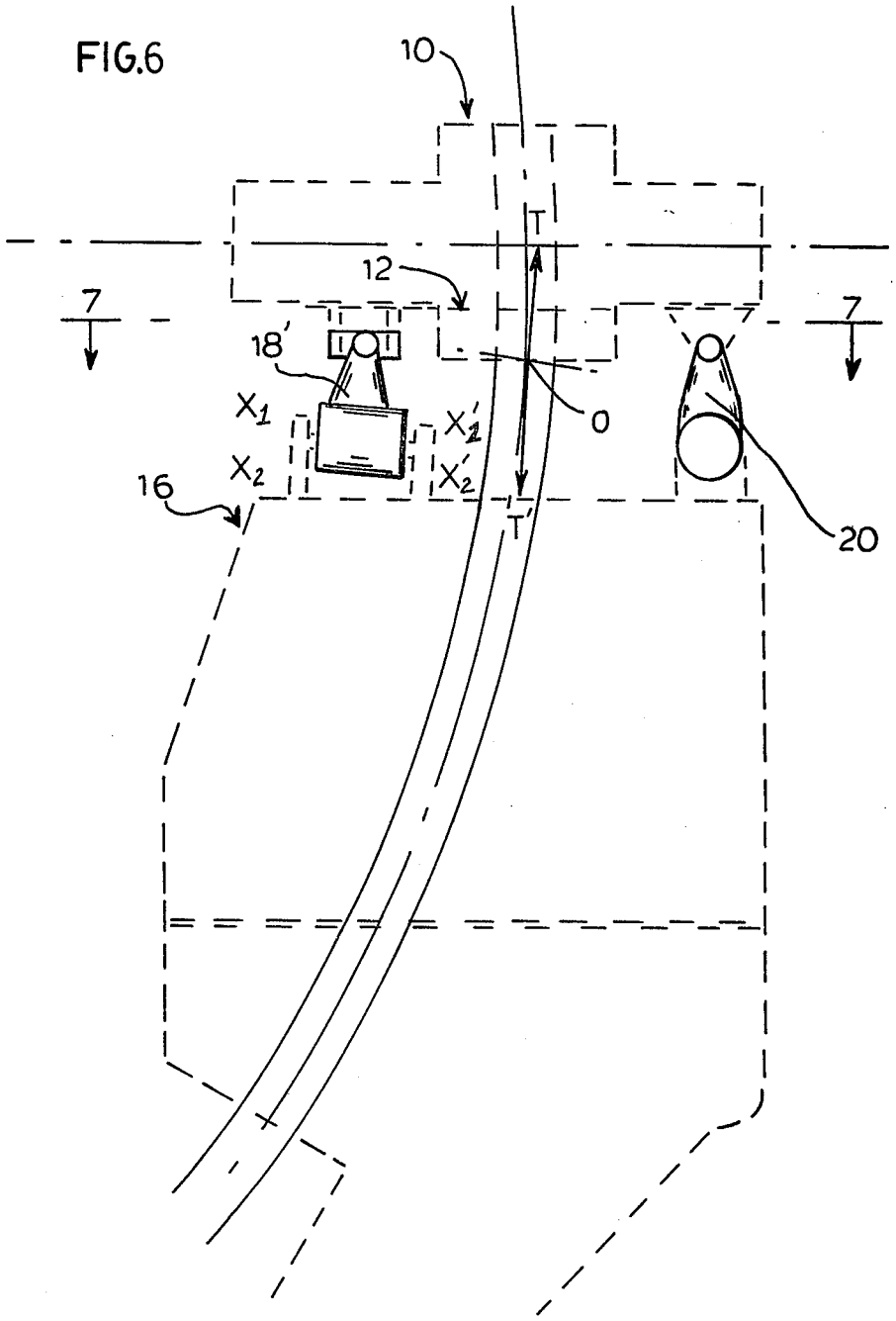
FIG. 6 is a side elevational view similar to that of FIG. 1 and showing a continuous casting machine for producing steel slabs.
Figure 7:
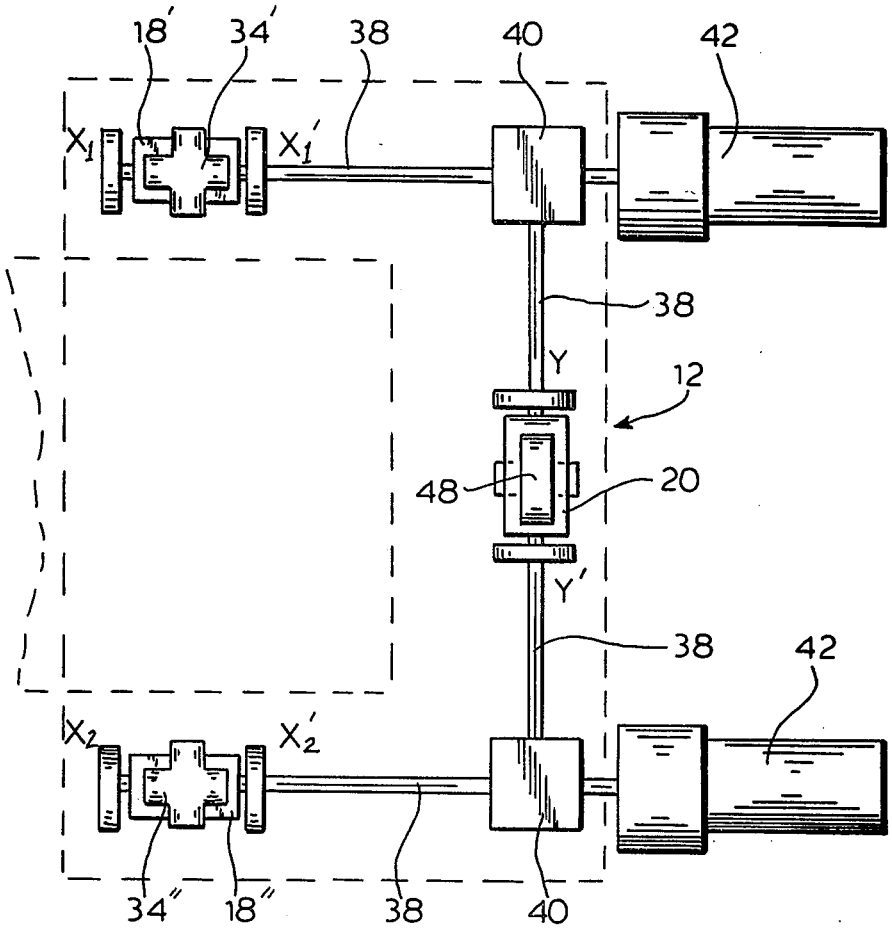
FIG. 7 is a horizontal section along line 7—7 of FIG. 6.

FIGS. 6 and 7 show an embodiment of a continuous casting machine with a mold for producing steel slabs of large dimensions and a mold support consisting of a rectangular frame 12 having two short sides and two long sides (shown in broken lines in FIG. 6). This frame or oscillating table is supported at three points by doubling the number of first or guiding connecting rods, i.e. providing a pair of connecting rods 18', 18'' disposed respectively at the short sides of rectangular frame support 12, close to the interior long side, i.e. the long side closest to the center of curvature of the molding passage of mold 10. The ends of connecting rods 18', 18'' opposite to the one ends thereof pivotally connected to oscillating table 12 are mounted on a pair of first cam shafts (see FIG. 7), the two first cam shafts having respective axes $X_1$—$X'_1$ and $X_2$—$X'_2$ parallel to the short sides. The two first connecting rods are arranged symmetrically with respect to a plane extending therebetween perpendicularly to the respective first cam shaft axes. Second connecting rod 20 is disposed at the center of the other long side of rectangular frame support 12, horizontal axis Y—Y' of the second cam shaft being parallel to the long sides of the rectangular frame support and perpendicular to the axes of the first cam shafts.

As in the above-described embodiments, the first cam shaft axes are perpendicular to the direction of tangent TT' on the axis of the continuous casting at point 0 situated in the plane of the discharge outlet of mold 10 when the same is in its median position, and these axes are parallel to the vertical plane which contains the axis of the casting and are disposed at respective sides thereof.

The mold again has a curved molding passage for the continuous casting, and the first cam shafts have cams of a different eccentricity than that of the cam of the second cam shaft. Cardan joints 34', 34'' pivotally connect the ends of first connecting rods 18', 18'' to oscillating table 12. Furthermore, cardan joint 48 pivotally connects second connecting rod 20 to table 12 to prevent the rod and cam shaft from being subjected to excessive stresses if the oscillating table is deformed.

In an installation of this type, it would also be possible to double the number of second or balancing connecting rods with their cam shaft mountings. It would also be possible to dispose two connecting rods at the center of the long sides of the mold support table, the axes of the cam shafts on which they are mounted being parallel to each other and perpendicular to a vertical plane containing the axis of the continuous casting.

All the cam shafts are coupled together by coupling rods 38 and bevel gear boxes 40 so that they are driven in synchronism by two motors 42.

Figure 8:
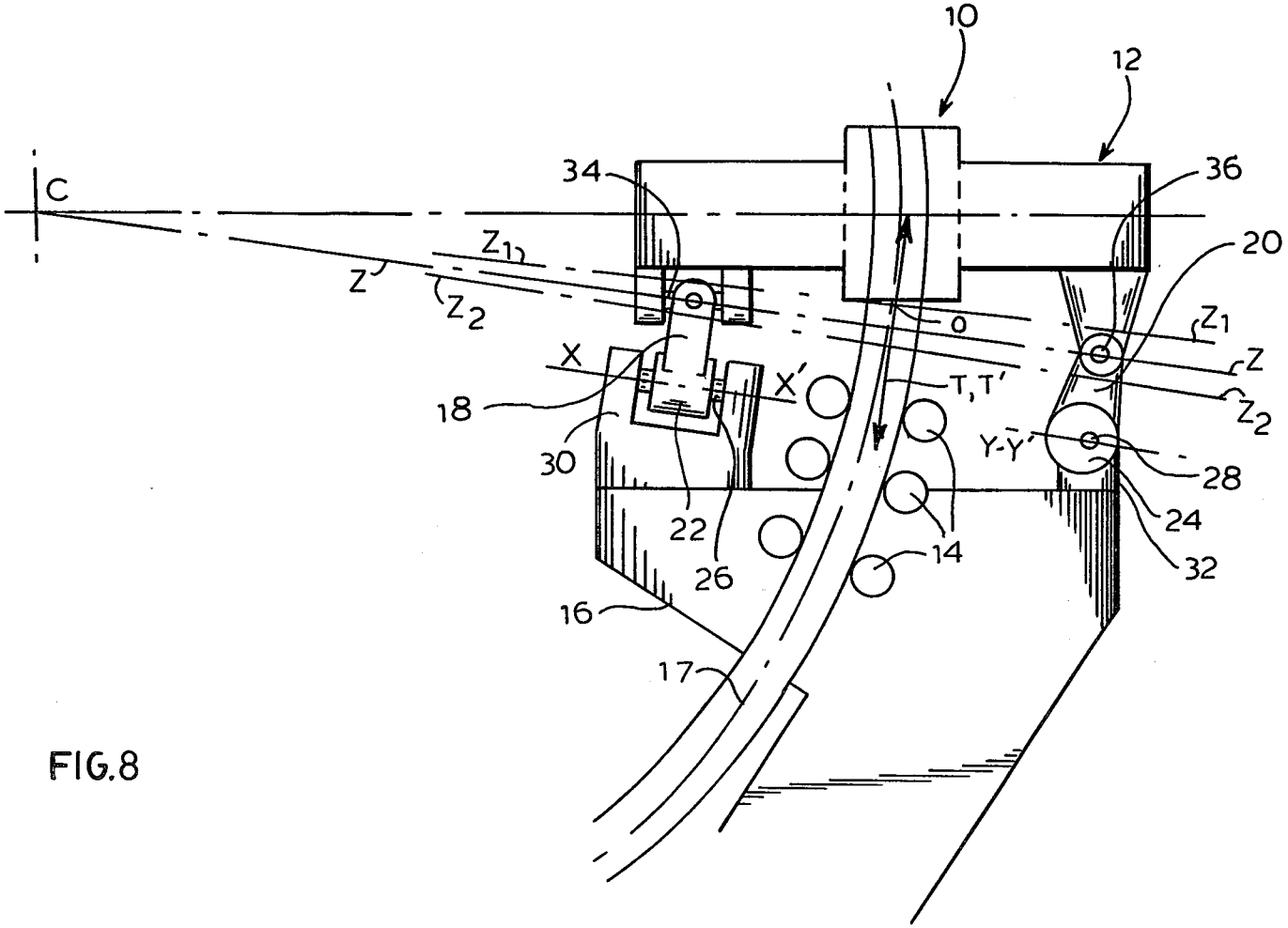
FIG. 8 is a side elevational view similar to that of FIG. 1 and showing yet another embodiment of the present invention.

In the embodiment of FIG. 8, oscillating mold support table 12 is supported by first or guiding connecting rod 18 and second or balancing connecting rod 20. As indicated hereinabove, these connecting rods (with their cam shafts) may be provided in pairs.

The center of cardan joint 34 pivotally connecting rod 18 to the mold and the axis of pivot shaft 36 connecting connecting rod 20 to the mold define a plane Z—Z' extending perpendicularly to axis 17 of the continuous casting at point 0 where this axis intersects this plane. This plane contains the center C of curvature of the casting axis. Furthermore, the two cam shafts are so arranged that cams 22 and 24 impart oscillations to mold 10 whose amplitudes have the same relation as the distances between the center of joint 34 and the axis passing through center C of curvature of axis 17 of the continuous casting and is perpendicular to a vertical plane containing this axis, on the one hand, and the axis of pivot 36 and said axis passing through the center of curvature of the continuous casting, on the other hand. Point 0 is situated adjacent the outlet of mold 10. With this arrangement, when the mold oscillates, plane Z—Z' always remains in a position perpendicular to axis 17 of the continuous casting at the point where this plane intersects this axis. Planes $Z_1$—$Z'_1$ and $Z_2$—$Z'_2$ represent the positions of this plane in the extreme upper and lower positions of mold 10.

When the mold is in its median position, axis X—X' of first cam shaft 22, 26 is parallel to plane Z—Z' and, therefore, perpendicular to tangent TT' at point 0. In this position, the axis of the molding passage of mold 10 coincides with axis 17 of the continuous casting. When mold 10 is spaced upwardly or downwardly from its median position, the axis of its molding passage is displaced in relation to casting axis 17 but, due to the present arrangement according to which the eccentricities of cams 22 and 24 differ from each other and plane Z—Z' is maintained perpendicular to axis 17 of the continuous casting, and further taking into consideration that the amplitude of the oscillations is small and the radius of the curvature of the casting axis is large, the differences between the actual trajectory of the mold and the axis of the casting remain very small, particularly in the region of point 0, which is close to the interior face of the mold or in its plane, in which region the axis of the molding passage always remains aligned with the axis of the continuous casting.

If the first and/or the second connecting rods are doubled, the centers of their universal joint connections to the mold and/or of the pivotal connections thereof are all disposed in plane Z—Z'.

While the invention has been described and illustrated solely in connection with embodiments wherein the molding passage is curved, it is also applicable to continuous casting installations with a mold having a straight molding passage for the continuous casting. In this case, the axis of the first cam shaft is perpendicular to the axis of the molding passage and, if the latter is inclined, parallel to a vertical plane containing the molding passage axis. The eccentricities of the cams driving the first and second connecting rods are the same and the universal joint connecting the first connecting rod to the mold or to its support may be replaced by a shaft whose axis is parallel to the axis of its cam shaft.

Various modifications accomplishing the same object with equivalent means may occur to those skilled in the art without departing from the spirit and scope of this invention, as defined in the appended claims.

What we claim is:

1. In a continuous casting machine comprising a mold having a mold cavity and a discharge outlet, and a guide rack arranged in alignment with said mold cavity for guiding a continuous casting from the discharge outlet of the mold, the mold cavity and the guide rack together defining a casting path an apparatus for controlling and guiding oscillations of the mold, comprising (a) a fixed support, (b) a first connecting rod pivotally connected to the mold at one end thereof, (c) a first cam shaft carried by the fixed support, the first cam shaft having an axis extending perpendicularly to the axis of the casting path or to the direction of a tangent on said axis at a point adjacent the mold outlet and parallel to a vertical plane containing said casting path axis, an end of the first connecting rod opposite to the one end being mounted on the first cam shaft, (d) a second connecting rod pivotally connected to the mold at an end thereof, and (e) a second cam shaft carried by the fixed support, the second cam shaft having a horizontal axis extending perpendicularly to the axis of the first cam shaft, an end of the second connecting rod opposite to the one end being mounted on the second cam shaft, the mounting of each connecting rod on a respective one of the cam shafts being arranged to prevent any movement of the connecting rod with respect to the fixed support and to the mold in a direction parallel to the axis of the respective can shaft.

2. The apparatus of claim 1, further comprising a support for the mold, the one ends of the connecting rods being pivotally connected to the mold support.

3. The apparatus of claim 1, wherein the two connecting rods are disposed at opposite sides of the mold.

4. The apparatus of claim 1, wherein the two connecting rods are disposed at the same side of the mold.

5. The apparatus of claim 1, further comprising a shaft having an axis parallel to the axis of the second cam shaft, the one end of the second connecting rod being pivotally mounted on said shaft.

6. The apparatus of claim 5, wherein the mold is a mold having a curved mold cavity for the continuous casting, further comprising means for synchronously driving the two cam shafts, the cam shafts having cams of different eccentricity, and a universal joint pivotally connecting the first connecting rod to the mold.

7. The apparatus of claim 6, wherein the center of the universal joint and the axis of the pivot connecting the second connecting rod to the mold define a plane extending perpendicularly to the casting path axis at a point where this axis intersects this plane.

8. The apparatus of claim 2, wherein the mold is a mold for producing steel slabs and the mold support is a rectangular frame having two short sides and two long sides, and comprising a pair of said first connecting rods disposed respectively at the short sides of the rectangular frame support, the ends of the first connecting rods opposite to the one ends being mounted on a pair of first cam shafts, the two first cam shafts having respective axes parallel to the short sides, the two first connecting rods being arranged symmetrically with respect to a plane extending therebetween perpendicularly to the respective first cam shaft axis, and the second connecting rod is disposed at the center of one of the long sides of the rectangular frame support, the axis of the second cam shaft being parallel to the long sides of the rectangular frame support.

9. The apparatus of claim 8, wherein the mold is a mold having a curved mold cavity for the continuous casting, wherein the first cam shafts have cams of a different eccentricity than that of the cam of the second cam shaft, and further comprising universal joints pivotally connecting the ends of the first connecting rods to the rectangular frame support.

10. The apparatus of claim 9, further comprising a universal joint pivotally connecting the second connecting rod end to the rectangular frame support.

11. The apparatus of claim 7, wherein the two cam shafts are arranged to impart to the mold oscillations whose amplitudes have the same relation as the distances between the center of the universal joint and the axis passing through the center of curvature of the casting path axis and being perpendicular to a plane containing this axis, on the one hand, and the axis of the pivot connecting the second connecting rod to the mold and said axis passing through the center of the curvature of the casting path, on the other hand.

12. The apparatus of claim 7, wherein said point is situated adjacent the outlet of the mold.

13. The apparatus of claim 1, comprising a pair of said second connecting rods, the ends of the second connecting rods opposite to the one ends being mounted on a pair of said second cam shafts, the two second cam shafts being axially aligned and spaced from each other, and further comprising a bevel gear arrangement driving the first and second cam shafts.

* * * * *